US008931406B2

(12) United States Patent
Detloff et al.

(10) Patent No.: US 8,931,406 B2
(45) Date of Patent: Jan. 13, 2015

(54) DELIVER DRUM AND PERFECTING PRINTING PRESS HAVING THE DELIVERY DRUM

(75) Inventors: Andreas Detloff, Walldorf (DE); Michael Gieser, Oftersheim (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1138 days.

(21) Appl. No.: 12/053,643

(22) Filed: Mar. 24, 2008

(65) Prior Publication Data

US 2008/0229947 A1 Sep. 25, 2008

(30) Foreign Application Priority Data

Mar. 23, 2007 (DE) ..... 10 2007 014 148

(51) Int. Cl.
*B41F 13/24* (2006.01)
*B65H 29/04* (2006.01)

(52) U.S. Cl.
CPC ..... *B65H 29/041* (2013.01); *B65H 2404/341* (2013.01); *B65H 2406/15* (2013.01); *B65H 2406/332* (2013.01); *B65H 2406/3661* (2013.01); *B65H 2801/21* (2013.01)
USPC ..... 101/232; 101/231

(58) Field of Classification Search
CPC ..... B65H 2406/33; B65H 2406/331; B65H 2406/3312; B65H 2406/332
USPC ..... 101/217, 231, 232, 420, 230
See application file for complete search history.

(56) References Cited

U.S. PATENT DOCUMENTS

| | | | | |
|---|---|---|---|---|
| 3,542,358 | A | 11/1970 | Schuhmann | |
| 3,986,455 | A * | 10/1976 | Jeschke et al. | 101/409 |
| 4,378,734 | A | 4/1983 | Wirz | |
| 4,552,069 | A * | 11/1985 | Jahn | 101/420 |
| 4,690,054 | A | 9/1987 | Cappel et al. | |
| 5,927,203 | A * | 7/1999 | Gieser et al. | 101/419 |
| 6,043,836 | A | 3/2000 | Kerr et al. | |
| 6,401,608 | B1 * | 6/2002 | Lyon et al. | 101/136 |
| 6,581,517 | B1 | 6/2003 | Becker et al. | |
| 6,612,236 | B2 | 9/2003 | Frankenberger et al. | |
| 2005/0012265 | A1 | 1/2005 | Berlingen et al. | |
| 2006/0180040 | A1 * | 8/2006 | Hachmann | 101/477 |

FOREIGN PATENT DOCUMENTS

| | | |
|---|---|---|
| DE | 1 561 043 B | 3/1970 |
| DE | 23 54 418 C3 | 5/1975 |

(Continued)

OTHER PUBLICATIONS

German Patent Office Search Report, dated Nov. 16, 2007.

*Primary Examiner* — Judy Nguyen
*Assistant Examiner* — Justin Olamit
(74) *Attorney, Agent, or Firm* — Laurence A. Greenberg; Werner H. Stemer; Ralph E. Locher

(57) ABSTRACT

A delivery drum includes at least one supporting shell for supporting a printed sheet and for producing a vacuum region between the supporting shell and the printed sheet. The supporting shell extends over the entire width of the printed sheet. A circumferential length, which is at least one quarter of the sheet length of the printed sheet, is disposed between the sheet start of the printed sheet and the start of the vacuum region.

10 Claims, 4 Drawing Sheets

(56) References Cited

FOREIGN PATENT DOCUMENTS

| | | | |
|---|---|---|---|
| DE | 30 36 790 | A1 | 4/1982 |
| DE | 195 45 799 | C1 | 1/1997 |
| DE | 198 53 574 | A1 | 6/1999 |
| DE | 10 2004 031 171 | A1 | 2/2005 |
| JP | 61252163 | A | 11/1986 |
| JP | 2000108299 | A | 4/2000 |
| JP | 2002128315 | A | 5/2002 |
| JP | 2005035269 | A | 2/2005 |

* cited by examiner

DELIVER DRUM AND PERFECTING PRINTING PRESS HAVING THE DELIVERY DRUM

CROSS-REFERENCE TO RELATED APPLICATION

This application claims the priority, under 35 U.S.C. §119, of German Patent Application DE 10 2007 014 148.5, filed Mar. 23, 2007; the prior application is herewith incorporated by reference in its entirety.

BACKGROUND OF THE INVENTION

Field of the Invention

The present invention relates to a delivery drum, for example of a printing press. The invention also relates to a printing press having the delivery drum.

In German Published, Prosecuted Patent Application DE-AS 1 561 043, corresponding to U.S. Pat. No. 3,542,358, a delivery drum is described which has segments forming blowing chambers. A porous covering is stretched over the segments and a Perlon cloth is stretched over the former. Blown air from the segments emerges through the pores of the covering and the Perlon cloth in order to form a thin air cushion on the drum circumference, which prevents contact between the printed sheet and the delivery drum. Although that application of positive pressure prevents smearing of the printing ink from the sheet onto the drum it does not, however, prevent the printing ink from the sheet transported by the delivery drum from being smeared onto machine parts adjacent the delivery drum.

In addition to that delivery drum to which positive pressure is applied, a delivery drum to which vacuum is applied is also known.

In German Published, Non-Prosecuted Patent Application DE 10 2004 031 171 A1, corresponding to U.S. Patent Application Publication No. US 2005/0012265 A1, an evacuated delivery drum is described, which includes disks provided with air-suction channels in order to carry the sheets. The two disks are mounted on a chain wheel shaft in such a way that they can be displaced along the latter. By displacement of the two disks, they can be adjusted closer together or further apart as desired, in order to position each of the two disks in a manner coordinated with the sheet format of the respective print job in such a way that the disks make contact with the sheets only at their side edges which are free of a printed image. However, in the case of that delivery drum, although the risk of smearing of the printing ink onto the adjacent machine parts is avoided, the delivery drum presupposes the existence of side edges free of a printed image. However, in the case of specific print jobs, it is desirable to cover the offset printed image on the printed sheet with a full-area clear varnish layer, which extends beyond the offset printed image and into the region of the side edge which is free of a printed image and virtually as far as the side edge of the sheet. In the case of such a print job, there would be the risk of the varnish from the side edge which is free of a printed image being smeared onto the disk supporting the sheet therein.

Only more distant prior art is disclosed by German Patent DE 195 45 799 C1, in which a sheet carrying cylinder is described that is disposed between two impression cylinders. That sheet carrying cylinder has slot nozzles with a blowing direction that is oriented substantially counter to the direction of rotation of the sheet carrying cylinder.

BRIEF SUMMARY OF THE INVENTION

It is accordingly an object of the invention to provide a delivery drum and a perfecting printing press having the delivery drum, which overcome the hereinafore-mentioned disadvantages of the heretofore-known devices of this general type, in which there is no risk of smearing of printing ink from a sheet onto machine parts adjacent the delivery drum and which does not presuppose any unvarnished sheet side edges.

With the foregoing and other objects in view there is provided, in accordance with the invention, a delivery drum, comprising at least one supporting shell for supporting a printed sheet and for producing a vacuum region between the supporting shell and the printed sheet. The supporting shell extends over an entire width of the printed sheet. A circumferential length extends between a sheet start of the printed sheet and a start of the vacuum region. The circumferential length is at least one quarter of a sheet length of the printed sheet.

Through the use of the delivery drum according to the invention, the printed sheet supported thereby is forced precisely into its desired movement path. This minimizes the risk that this sheet will strike machine parts adjacent the delivery drum and that printing ink from the printed sheet will be smeared onto the latter. At the same time, however, printing ink or varnish from this printed sheet is also prevented from being smeared onto the delivery drum itself or the supporting shell of the latter.

In accordance with another feature of the invention, the supporting shell has slot nozzles producing the vacuum region. These slot nozzles can be produced by a circularly arced or sickle-shaped slot being introduced into a metal sheet forming the supporting shell, for example through the use of laser cutting, for each slot nozzle. A bead which is subsequently produced in the metal sheet forms a guide air bevel falling toward the slot.

In accordance with a further feature of the invention, the slot nozzles have a blowing direction oriented substantially in the direction of rotation of the supporting shell. In this case, the central jet of the beam or array of blown air expelled from the respective slot nozzle is oriented in the transport direction of the printed sheet supported by the supporting shell. In this case, the blowing direction can deviate from the aforethe direction of rotation and transport by an angle amounting to a few degrees, for example by an angle amounting to less than 10° or preferably less than 5°. The blowing direction of the slot nozzles is preferably aligned precisely with the direction of transport and rotation. The special feature of the alignment of the slot nozzles is that they blow substantially in the direction of rotation of the supporting shell and not counter to the aforethe direction of rotation.

In accordance with an added feature of the invention, the slot nozzles are blower nozzles producing the vacuum region through the use of the aerodynamic paradox. In this case, the blown air expelled from the slot nozzles forms a blown air stream which flows along the gap that is formed by the supporting shell and the printed sheet located above the latter. This blown air stream produces a suction or a vacuum which keeps the printed sheet in the vicinity of the supporting shell without contact.

In accordance with an additional feature of the invention, the supporting shell begins substantially at the start of the vacuum region. In this case, the leading edge of the supporting shell in the direction of rotation of the delivery drum is located approximately where the vacuum region starts. In this development, the supporting shell is shortened as compared with a development explained below.

In accordance with this development of the invention, which was already mentioned, a positive pressure region is located between the sheet start and the start of the vacuum region. This positive pressure region is a blown air cushion or pad carrying the front sheet section which is particularly threatened with respect to smearing on the supporting shell.

In accordance with yet another feature of the invention, through the use of restrictor nozzles, a blowing force is exerted on the printed sheet which falls over-proportionately, that is to say more than linearly, with its increasing distance from the restrictor nozzle. Thus, between the circumferential surface of the supporting shell provided with the restrictor nozzles and the printed sheet located above it, it is possible for a desired air pad which is much thinner, but which nevertheless keeps the printed sheet at a secure distance from the circumferential surface, to be produced, than would be possible with conventional, that is to say unrestricted, blower nozzles.

In accordance with yet a further feature of the invention, the supporting shell is disposed on a chain wheel shaft. This chain wheel shaft carries a chain wheel at each of its two ends, which is in engagement with a chain of a chain conveyor of a sheet delivery including the delivery drum. The supporting shell is located between the two chain wheels. The two endless chains wrapping around the chain wheels run along an intrinsically closed, annular circulation path, inside which the delivery drum is disposed.

In accordance with yet an added feature of the invention, the chain wheel shaft has a hollow construction as a blown air conduit. The construction of the chain wheel shaft as a hollow shaft makes it possible to feed the slot nozzles and/or restrictor nozzles with blown air through the interior of the chain wheel shaft. The chain wheel shaft is thus a constituent part of a conduit system supplying the slot nozzles and/or restrictor nozzles with the blown air.

With the objects of the invention in view, there is concomitantly provided a perfecting printing press, comprising a varnishing unit having an impression cylinder, and a delivery drum, according to the invention or one of its developments, disposed downstream of the impression cylinder.

Other features which are considered as characteristic for the invention are set forth in the appended claims.

Although the invention is illustrated and described herein as embodied in a delivery drum and a perfecting printing press having the delivery drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. Structurally and functionally advantageous developments of the invention are also included in the following description of preferred exemplary embodiments and the associated drawing.

DETAILED DESCRIPTION OF THE INVENTION

Figure 1:
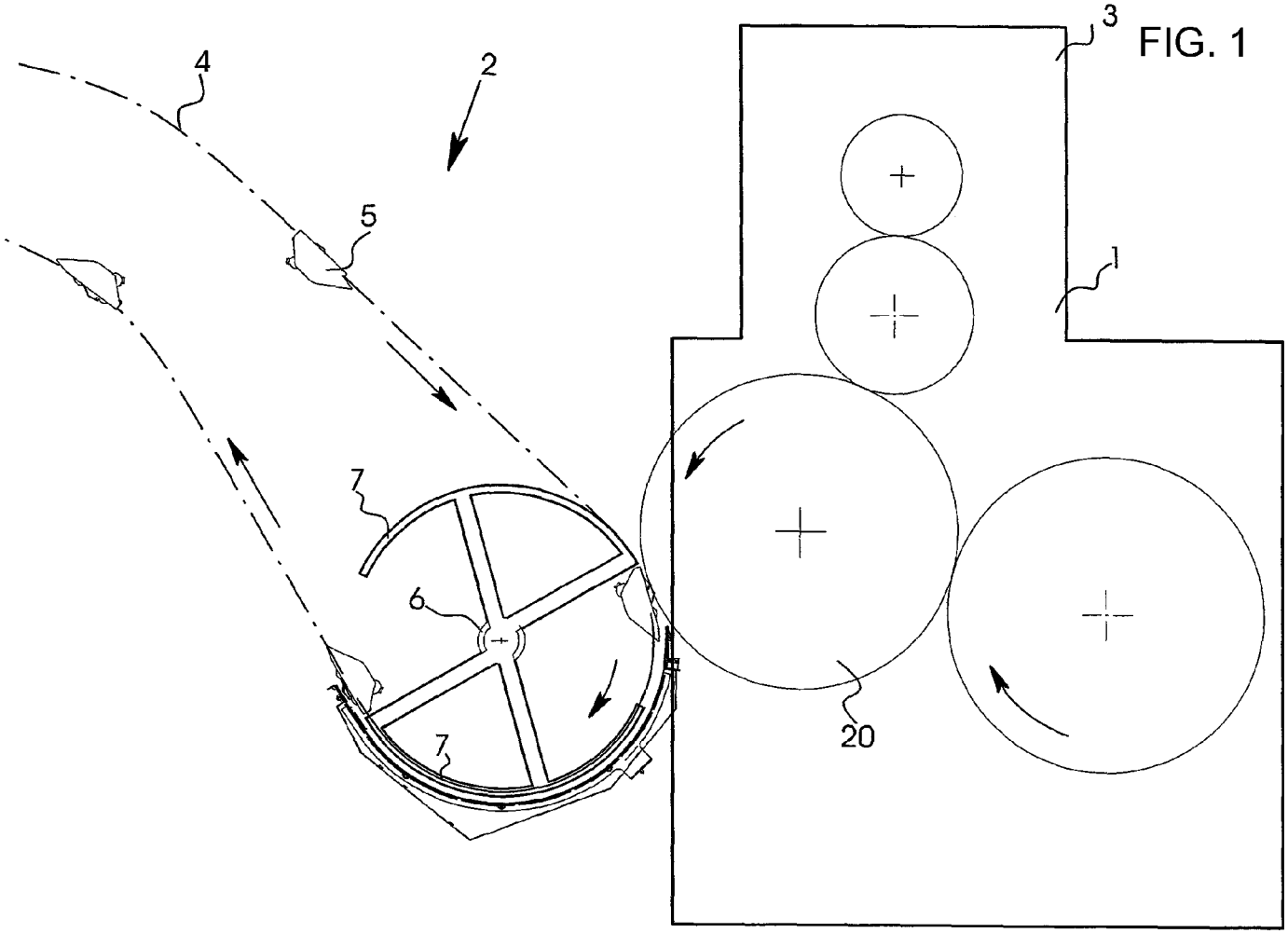
FIG. 1 is a diagrammatic, side-elevational view of a perfecting printing press having a sheet delivery which includes a delivery drum.

Referring now to the figures of the drawings in detail and first, particularly, to FIG. 1 thereof, there is seen a machine 1 for processing printed sheets. The machine is a perfecting printing press having offset printing units for printing the front side of the sheet and having offset printing units for printing the rear side of the sheet. For reasons of improved clarity, none of the offset printing units is illustrated in the drawing. In addition, the machine 1 includes a sheet delivery 2 and a varnishing unit 3, which is disposed between the last of the offset printing units in the sheet transport direction and the sheet delivery 2. The sheet delivery 2 includes a chain gripper 4 having gripper bars 5 for holding the leading edges of the sheets.

In addition, the sheet delivery 2 includes a delivery drum 6, around which the chain gripper 4 revolves. The delivery drum 6 includes two diametrical supporting shells 7, which are used to support the printed sheets pneumatically and determine a circumferential surface of the delivery drum 6. This circumferential surface is interrupted by two gaps located between the supporting shells 7, into which the gripper bars 5 dip during their revolution.

In a modification that is not illustrated in the drawing, the supporting shells 7 are mounted in such a way that they can be pivoted. A substantially oval or rhomboidal cross section of the delivery drum 6 can be set by pivoting the supporting shells 7 inward, and a circular cross section can be set by pivoting them outward.

Figure 2:
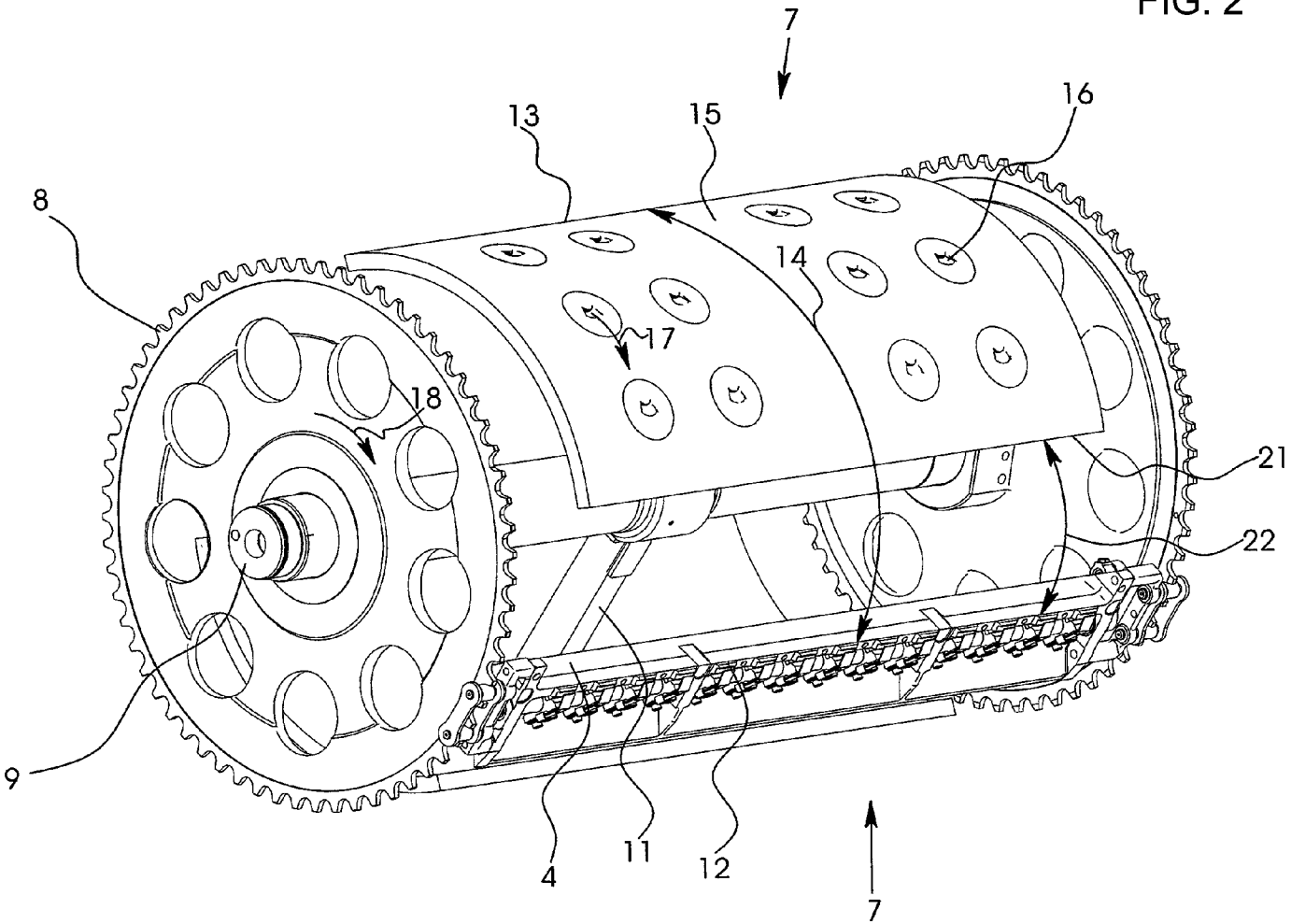
FIG. 2 is an enlarged, perspective view of a first exemplary embodiment of the delivery drum, in which its shortened supporting shell supports only a rear sheet section.

FIG. 2 shows that the delivery drum 6 is disposed coaxially with chain wheels 8 of the chain gripper 4. Blown air is applied to blowing chambers 10 (see FIG. 4) of the supporting shells 7 through a hollow chain wheel shaft 9. The supporting shells 7 are fixed to the chain wheel shaft 9 through spokes 11, so that they rotate together with the former. The supporting shells 7 extend in the axial direction of the delivery drum 6 over the entire width of the largest possible format of the printed sheets.

During the revolution of the respective gripper bar 5 around the chain wheel shaft 9, which is carried out on a circular arc, the gripper bar 5 is temporarily located in a fixed position (phase angle) relative to the trailing supporting shell 7, as is illustrated in the figure. During this movement phase of the printed sheet, its leading edge is held fast in the gripper bar 5 and its trailing edge is located in the region of the supporting shell 7. In the case of the largest possible sheet format, the trailing edge of the sheet can be substantially flush with the trailing edge of the supporting shell 7.

Accordingly, the gripper bar 5 determines a sheet start 12, and the trailing edge of the supporting shell 7 determines a sheet end 13, of the printed sheet. The circumferential length located between the sheet start 12 and the sheet end 13 corresponds to a sheet length 14 of the printed sheet.

Each supporting shell 7 has a nozzle area 15 with slot nozzles 16 having a blowing direction 17 which corresponds substantially to a direction of rotation 18 of the delivery drum 6. The nozzle area 15 is located substantially at a radial height of gripper pads of the gripper bars 5, to be precise slightly thereunder. The slot nozzles 16 are Venturi nozzles and, due to an aerodynamic paradox, produce a suction or vacuum region 19 (see FIG. 4) between the supporting shell 7 and the rear section of the printed sheet located above it. The vacuum region 19 assists the separation of the printed sheet from an impression cylinder 20 (see FIG. 1) of the varnishing unit 3 as the printed sheet is transferred from the impression cylinder 20 to the chain gripper 4 and the delivery drum 6. In the exemplary embodiment illustrated in FIG. 2, the vacuum region 19 is bounded by the leading edge of the supporting shell 7. As is seen in the direction of rotation 18, this leading edge forms a start 21 of the vacuum region 19.

A circumferential length 22, which amounts to at least one quarter (e.g. one third) of the sheet length 14, is located between the start 21 of the vacuum region 19 and the sheet start 12.

Figure 3:
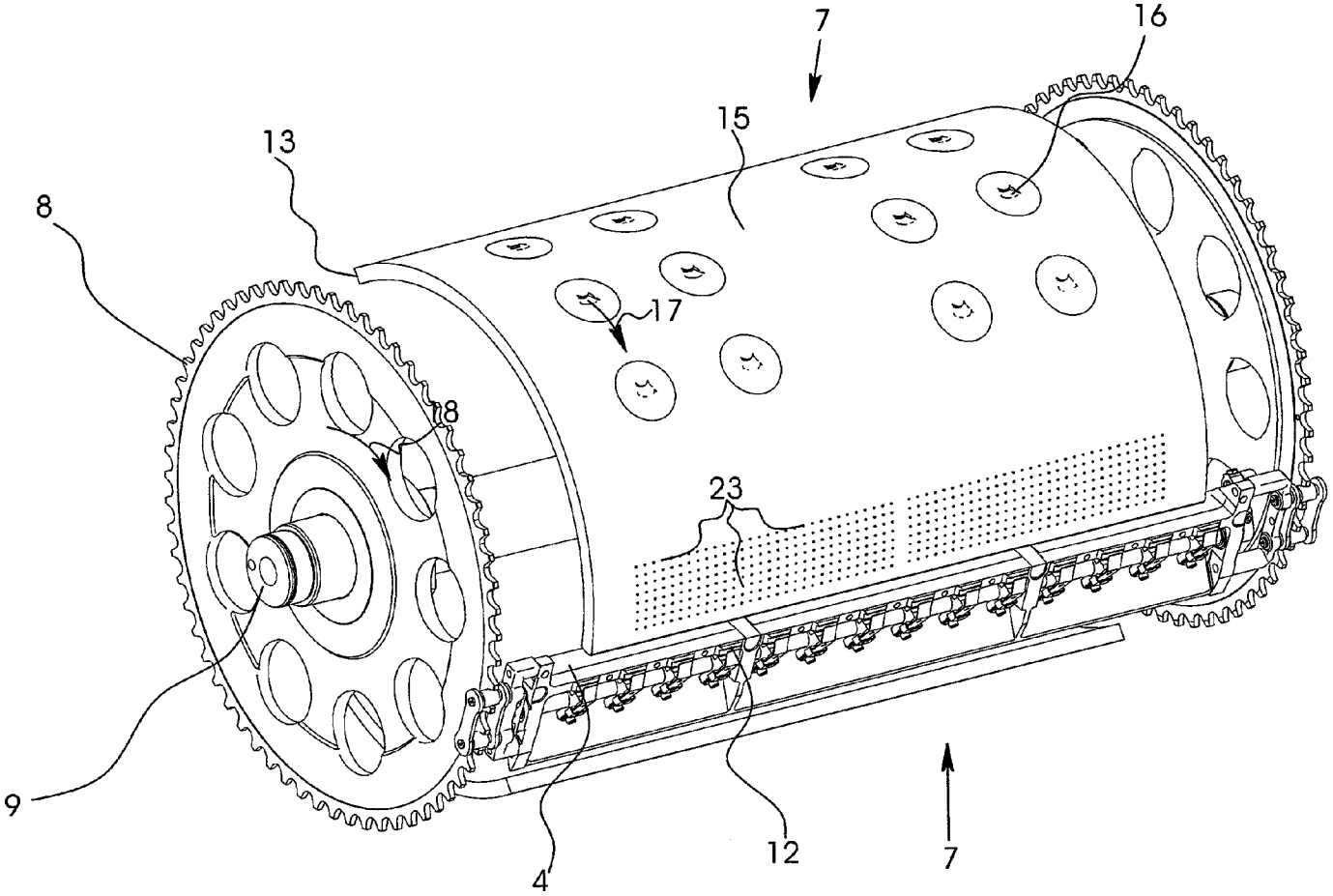
FIG. 3 is a perspective view of a second exemplary embodiment of the delivery drum, in which its unshortened supporting shell also supports a front sheet section.
Figure 4:
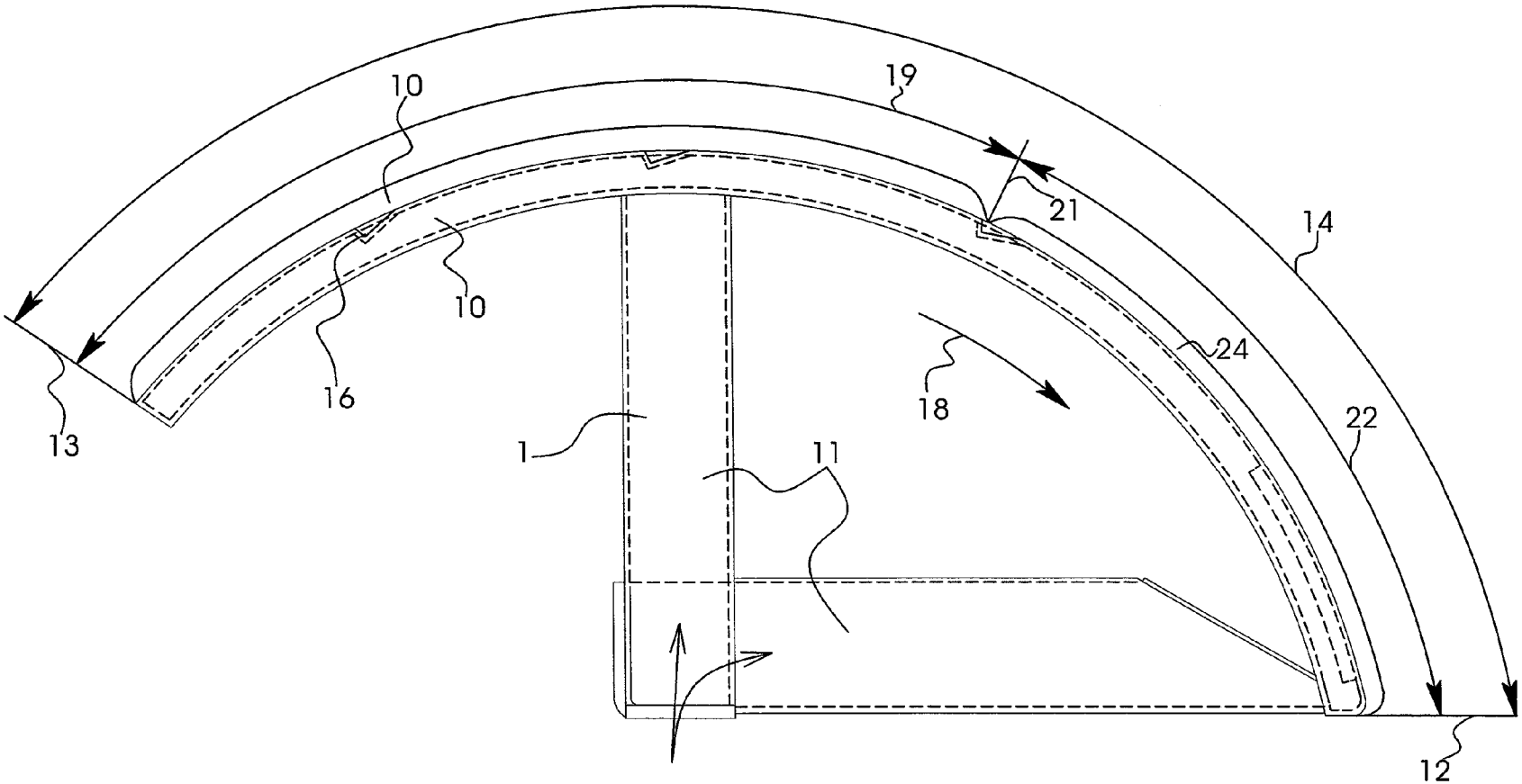
FIG. 4 is a side-elevational view of a portion of the supporting shell of the second exemplary embodiment.

FIGS. 3 and 4 show an exemplary embodiment which is a modification of that shown in FIG. 2, for which reason only the differences deviating therefrom will be explained. In the case of the delivery drum 6 in FIG. 3, the supporting shells 7 in each case extend substantially over the entire sheet length 14, so that in this case, as opposed to the exemplary embodiment according to FIG. 2, there is no large gap between the leading edge of the supporting shell 7 and the leading gripper bar 5, if the supporting shell 7 and the gripper bar 5 rotate in synchronism with each other around the chain wheel shaft 9. Instead of this gap, restrictor nozzles 23 are disposed in the nozzle area 15. These restrictor nozzles 23 are situated more closely beside one another than the slot nozzles 16 and have one or more blown air restrictors of the type which is shown in FIGS. 4 to 8 of German Published, Non-Prosecuted Patent Application DE 100 42 885 A1, corresponding to U.S. Pat. No. 6,612,236, and FIGS. 6 to 11 of German Published, Non-Prosecuted Patent Application DE 33 28 451 A1, corresponding to U.S. Pat. No. 4,552,069, and is described in the associated descriptions. The drawings and descriptions contained in the two last-mentioned patents with respect to the construction of the air restrictors are therefore incorporated by reference into the present application.

FIG. 4 shows that the restrictor nozzles 23 produce a positive pressure region 24 in the form of an air cushion between the supporting shell 7 and the printed sheet. The air cushion carries the leading section of the printed sheet immediately following the gripper bar 5 (see FIG. 3) and, as a result, prevents printing ink or varnish from the printed sheet from being smeared onto the supporting shell 7.

In the exemplary embodiment according to FIGS. 3 and 4, the circumferential length 22 which is enclosed by the sheet start 12 and the start 21 of the vacuum region 19 and within which the positive pressure region 24 also extends, amounts to at least one quarter of the sheet length 14 of the printed sheet being transported.

FIG. 4 shows that the respective supporting shell 7 in each case includes one of the blowing chambers 10 already mentioned above. The blowing chamber 10 extends from the vacuum region 19 into the positive pressure region 24. Both the slot nozzles 16 and the restrictor nozzles 23 of the respective supporting shell 7 are supplied with blown air through the common blowing chamber 10. In this case, the blown air flows out of the chain wheel shaft 9 (see FIG. 3), through the spokes 11 into the blowing chamber 10 and from the latter into the slot nozzles 16 and the restrictor nozzles 23. The slot nozzles 16 and the restrictor nozzles 23 are therefore connected to a common blown air generator, which is not illustrated in the drawing and to which the chain wheel shaft 9, functioning as a blown air conduit, is connected through a conduit system.

The invention claimed is:

1. A sheet delivery system, comprising:

a delivery drum including at least one rotatable supporting shell configured to support a printed sheet, said supporting shell configured to rotate in a direction of rotation and sheet transport, said supporting shell having blower nozzles configured to produce a vacuum region between said supporting shell and the printed sheet, said supporting shell reaching over an entire width of the printed sheet;

said blower nozzles configured to have a blowing direction oriented substantially in said direction of rotation and sheet transport of said supporting shell and not counter to said direction of rotation and sheet transport of said supporting shell; and a gripper bar to hold the printed sheet;

wherein when the gripper bar is temporarily located in a fixed position on the delivery drum relative to the supporting shell, a circumferential length extends between the gripper bar holding the printed sheet and a start of the vacuum region, wherein said circumferential length defines a gap between the gripper bar and the supporting shell.

2. The sheet delivery system according to claim 1, wherein said blower nozzles are slot nozzles producing said vacuum region.

3. The sheet delivery system according to claim 2, wherein said slot nozzles produce said vacuum region by an aerodynamic paradox.

4. A sheet delivery system, comprising:

a delivery drum including at least one rotatable supporting shell configured to support a printed sheet, said supporting shell configured to rotate in a direction of rotation and sheet transport, said supporting shell having blower nozzles configured to produce a vacuum region between said supporting shell and the printed sheet, said supporting shell reaching over an entire width of the printed sheet;

said blower nozzles configured to have a blowing direction oriented substantially in said direction of rotation and sheet transport of said supporting shell and not counter to said direction of rotation and sheet transport of said supporting shell; and a gripper bar to hold the printed sheet;

wherein when the gripper bar is temporarily located in a fixed position on the delivery drum relative to the supporting shell, a circumferential length of said supporting shell extends between the gripper bar holding the printed sheet and a start of the vacuum region and a positive pressure region is located along the circumferential length, wherein said supporting shell has restrictor nozzles along said circumferential length for producing said positive pressure region.

5. The sheet delivery system according to claim 1, which further comprises a chain wheel shaft on which said supporting shell is disposed.

6. The sheet delivery system according to claim 5, wherein said chain wheel shaft has a hollow construction and acts as a blown air circuit.

7. A perfecting printing press, comprising:

a varnishing unit having an impression cylinder; and a sheet delivery system according to claim 1 or 4 disposed downstream of said impression cylinder.

8. The sheet delivery system according to claim 5, wherein said delivery drum comprises more than one supporting shell, each supporting shell having a width reaching over an entire width of the printed sheet.

9. The sheet delivery system according to claim 5, wherein said at least one supporting shell supports a printed sheet continuously over an entire width of the printed sheet.

10. The sheet delivery system according to claim 5, wherein said at least one supporting shell supports a printed sheet continuously over an entire width of the printed sheet.

* * * * *